US006591945B1

(12) United States Patent
Kigawa et al.

(10) Patent No.: US 6,591,945 B1
(45) Date of Patent: Jul. 15, 2003

(54) SELF PROPELLED ELEVATOR

(75) Inventors: Hiroshi Kigawa, Tokyo (JP); Takashi Yumura, Tokyo (JP); Takenobu Honda, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/667,321

(22) Filed: Sep. 22, 2000

(30) Foreign Application Priority Data

Sep. 24, 1999 (JP) ..... 11-270179

(51) Int. Cl.[7] ..... B66B 9/02
(52) U.S. Cl. ..... 187/261; 187/262; 187/266
(58) Field of Search ..... 187/262, 266, 187/254, 258, 259, 261

(56) References Cited

U.S. PATENT DOCUMENTS

| | | | | | |
|---|---|---|---|---|---|
| 1,506,927 | A | * | 9/1924 | Hansen | 187/262 X |
| 2,644,545 | A | * | 7/1953 | North | 187/262 X |
| 4,433,752 | A | | 2/1984 | Günter | |
| 6,193,016 | B1 | * | 2/2001 | Hollowell et al. | 187/250 |

FOREIGN PATENT DOCUMENTS

| | | | | |
|---|---|---|---|---|
| AU | 224918 | * | 3/1958 | 187/262 |
| DE | 39939 | * | 6/1965 | 187/266 |
| EP | 565516 | * | 10/1993 | |
| FR | 2640604 | * | 6/1990 | 187/266 |
| JP | 62-31686 | | 2/1987 | |
| JP | 91-081791 | | 3/1999 | |

* cited by examiner

*Primary Examiner*—Steven A. Bratlie
(74) *Attorney, Agent, or Firm*—Leydig, Voit & Mayer, Ltd.

(57) ABSTRACT

A self-propelled elevator in which a drum type winding machine is attached to a cage, and the cage is elevated along guide rails arranged in a hoistway by a first winding rope, one end of which is fixed to a top portion of the hoistway and the other end portion of which is directly wound round a winding drum sheave of the drum type winding machine. In the self-propelled elevator, the drum type winding machine is attached to a lower side of a bottom portion of the cage so that an end face of the winding drum sheave around which the first winding rope is wound is located outside an area produced by projection of the cage.

11 Claims, 10 Drawing Sheets

SELF PROPELLED ELEVATOR

BACKGROUND OF THE INVENTION

1. Field of the Invention

The present invention relates to a self-propelled elevator in which a drive unit including an electric motor and a winding machine for winding up a cage of the elevator is arranged at the cage itself.

2. Description of Related Art

A rope type elevator requires a machine room, in which a winding machine and an electric motor are arranged, at the top of a hoistway. Therefore, the total height of a building in which the rope type elevator is installed is increased, and the construction cost of the building is raised, and further problems may be caused from the viewpoint of the right to sunshine.

In order to solve the above problems, there is proposed a self-propelled elevator in which a drive unit including a motor and a winding machine is arranged at a cage itself so that a machine room can be eliminated.

FIG. 10 is an arrangement view of a conventional self-propelled elevator disclosed in Japanese Unexamined Patent Publication No. 62-31686.

In the view, reference numeral 1 is a cage, reference numeral 2 is a guide rail, reference numeral 3 is a guide roller, reference numeral 4 is a drum type winding machine attached to the outside of the cage 1, reference numeral 5 is a winding rope, and reference numeral 6 is a hoistway. As shown in the view, according to the above conventional self-propelled elevator, the drum type winding machine 4 is arranged on the outside of the cage 1, and no machine room, which is necessary in the case of a rope type elevator, is provided at the top of the hoistway. Due to the above arrangement, it becomes possible to save a space in the direction of height of the hoistway. In this arrangement, the drum type winding machine 4 is arranged between the cage 1 and the hoistway 6.

However, the following problems may be encountered in the above conventional self-propelled elevator. In the above conventional self-propelled elevator, the drum type winding machine is arranged on the side of the cage between the outside of the cage and the wall of the hoistway. For the above reasons, although the space can be saved in the direction of the height of the hoistway, the plane space i.e. cross-sectional areas, of the hoistway is increased as compared with the conventional elevator in which the winding machine is arranged in the machine room.

Since the cage hanging position is located distant from the gravity center of the cage, an eccentric moment is generated in the cage. Therefore, loads given to the guide rails in the horizontal direction are increased.

Further, although not shown in FIG. 10, since the winding rope is wound round the winding drum sheave so that the winding rope can not overlap each other, a contact point of the winding rope with the winding drum sheave moves in the axial direction of the winding drum sheave.

Accordingly, a fleet angle, which is an angle by which the winding rope enters the rope groove of the winding drum sheave, fluctuates. Therefore, abrasion is caused in the winding rope and the suspension sheave.

Further, since the drum type winding machine is arranged at the cage, the weight of the cage is increased.

Accordingly, compared with the conventional arrangement in which the winding machine is arranged in the machine room, the size of the motor to drive the winding machine is increased, and further the electrical power consumption is increased.

SUMMARY OF THE INVENTION

The present invention has been accomplished to solve the above problems. It is an object of the present invention to reduce a plane space of a hoistway in a self-propelled elevator in which a cage is provided with a drum type winding machine.

It is another object of the present invention to reduce loads given to guide rails by preventing the generation of an eccentric moment caused by tension of a winding rope.

It is still another object of the present invention to reduce the fluctuation of a fleet angle of a winding rope so that the abrasion of a winding rope suspension sheave can be decreased and the reliability can be enhanced.

It is still another object of the present invention to reduce the size of an electric motor to drive a winding machine so that the electric power consumption can be reduced.

The present invention provides a self-propelled elevator in which a drum type winding machine is attached to a cage, and the cage is elevated along guide rails arranged in a hoistway by a first winding rope, one end of which is fixed to a top portion of the hoistway and the other end portion of which is directly wound round a winding drum sheave of the drum type winding machine, the self-propelled elevator characterized in that: the drum type winding machine is attached onto a lower side of a bottom portion of the cage so that an end face of the winding drum sheave round which the first winding rope is wound can be located outside a projected region of the cage in the perpendicular direction.

In a self-propelled elevator of the present invention, a suspension sheave is provided at a position opposed to the winding drum sheave on the lower side of the bottom of the cage, a second winding rope is provided, one end of which is fixed to a top of the hoistway and the other end of which is wound round the winding drum sheave after it has been wound round the suspension sheave, and the suspension sheave is arranged at a position so that an end face of the second winding rope which is wound round the suspension sheave from the top of the hoistway can be located outside the projected region of the cage in the perpendicular direction.

In a self-propelled elevator of the present invention, the suspension sheave is capable of swiveling.

In a self-propelled elevator of the present invention, the suspension sheave can be freely moved in a direction parallel with the axial direction of the winding drum sheave.

In a self-propelled elevator of the present invention, an outer circumferential portion of the suspension sheave round which the second winding rope is wound has a width of a predetermined length in a direction parallel with the axial direction of the winding drum sheave, and no grooves in which the second winding rope is wound are provided in the outer circumferential portion of the sheave.

In a self-propelled elevator of the present invention, a rope is provided, one end of which is fixed to the cage and the other end of which is fixed to a counterweight, and the rope is wound round a return sheave arranged at the top of the hoistway between the cage and the counterweight.

In a self-propelled elevator of the present invention, the weight of the counterweight is less than the self-weight of the cage.

In a self-propelled elevator of the present invention, the weight of the counterweight is not less than ½ of the self-weight of the cage and not more than ½ of the sum of the maximum carrying capacity and the self-weight of the cage.

DETAILED DESCRIPTION OF THE PRESENT INVENTION

Embodiment 1

Figure 1:
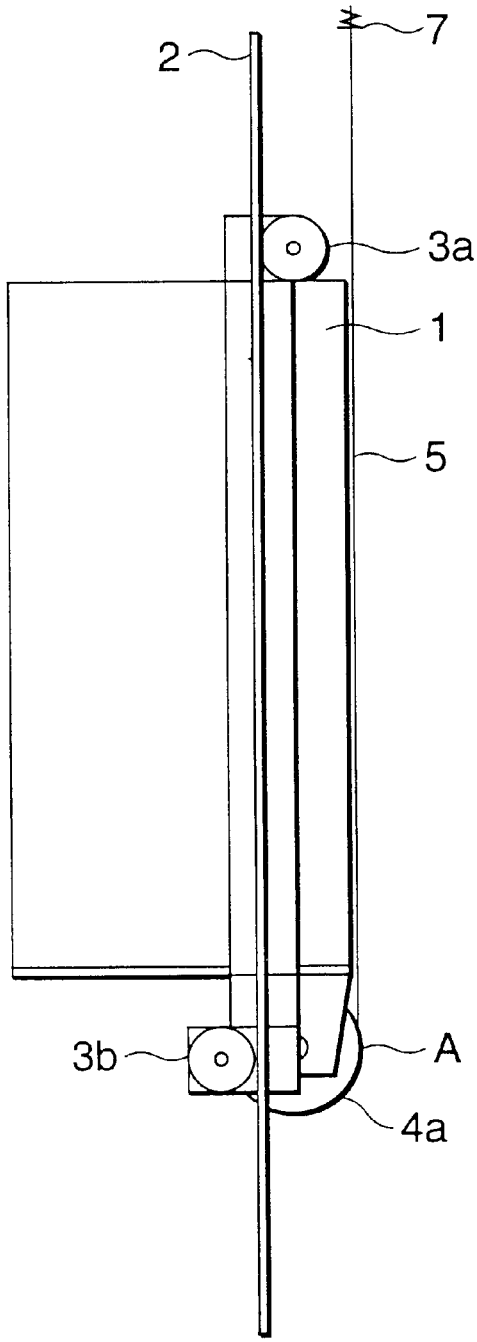
FIG. 1 is a side view briefly showing an arrangement of a self-propelled elevator of Embodiment 1.

Referring to the appended drawings, an embodiment of the present invention will be explained below. In this connection, like reference characters are used to indicate like parts in the views of the conventional example and those of the embodiment of the present invention.

Figure 2:
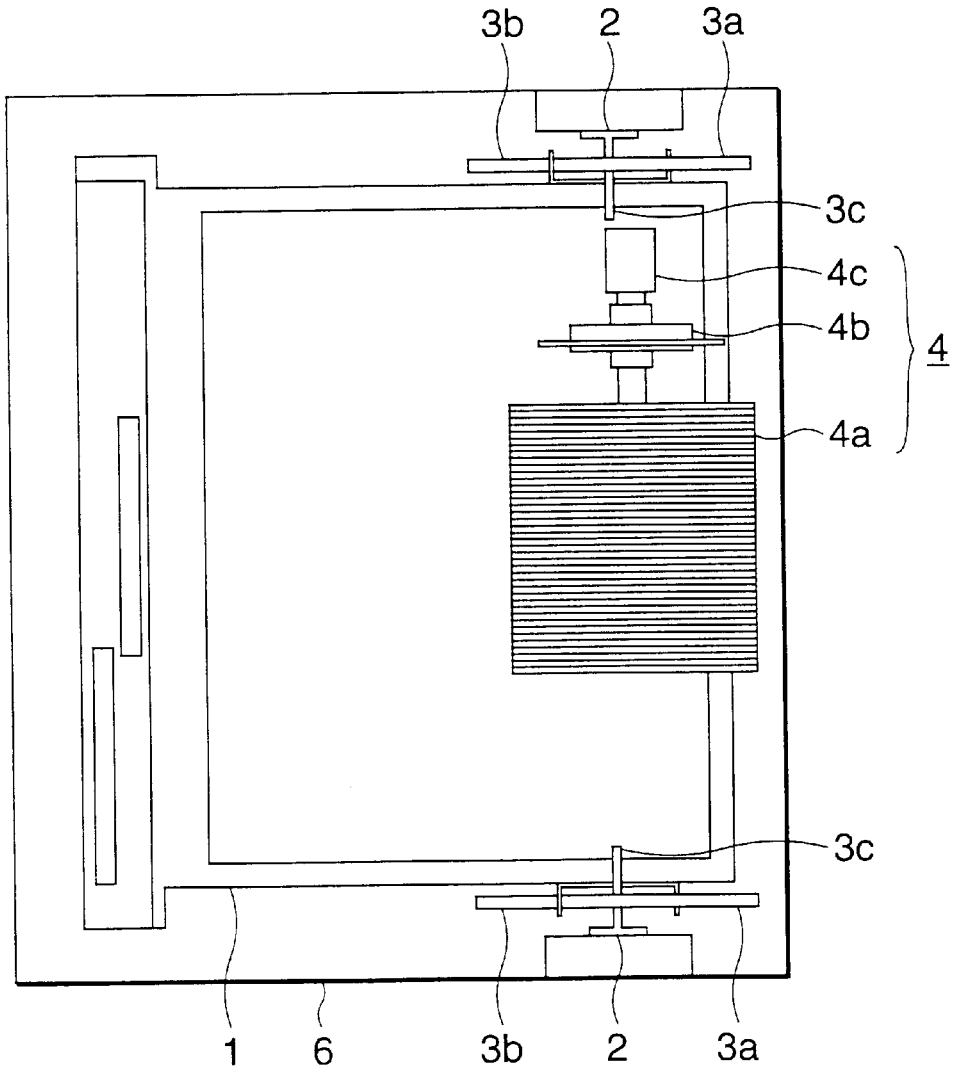
FIG. 2 is a plan view of the self-propelled elevator of Embodiment 1, wherein the view is taken from the lower side of the cage.

FIG. 1 is a side view briefly showing an arrangement of a self-propelled elevator of Embodiment 1. FIG. 2 is a plan view of the self-propelled elevator shown in FIG. 1, wherein the view is taken from the lower side.

In FIGS. 1 and 2, reference numeral 1 is a cage, and reference numeral 2 indicates a pair of guide rails which are arranged in parallel with each other in the traverse direction, whereby the elevating motion of the cage 1 is guided.

Reference numerals 3*a*, 3*b*, 3*c* are guide rollers which are attached to the cage 1 and roll along the guide rails 2. Reference numeral 3*a* is a guide roller arranged in an upper portion of the cage 1, and reference numeral 3*b* is a guide roller arranged in a lower portion of the cage 1. These guide rollers support an angular moment generated in the cage 1 round the rotational axis of the winding drum sheave.

Reference numerals 3*c* indicates four guide rollers attached to four positions of the cage 1. In this case, the four positions include a right upper position, right lower position, left upper position and left lower position. The angular moment to rotate the cage 1 on the plane formed by the two guide rails 2 is supported by the guide rollers.

Reference numeral 4 is a drum type winding machine attached to a lower portion (lower side of the bottom portion) of the cage 1. Reference numeral 4*a* is a winding drum sheave, reference numeral 4*b* is an electric motor, and reference numeral 4*c* is a brake.

That is, the drum type winding machine 4 includes a winding drum sheave 4*a*, electric motor 4*b* and brake 4*c*.

Reference numeral 5 is a first winding rope, one end of which is wound round the winding drum sheave 4*a* and the other end of which is fixed to the attaching section 7 of the top of the hoistway.

In the self-propelled elevator composed as described above, the drum type winding machine 4 is arranged in a lower portion of the cage 1, and an end face of the winding drum sheave 4*a* on which the first winding rope 5 comes into contact is located at a position so that the end face can be protruded from the projected region of the cage 1 in the perpendicular direction to the outside, that is, an end portion, which is shown by mark A in FIG. 1, of the winding drum sheave 4*a* round which the first winding rope 5 is wound is located at a position so that the end portion can be protruded from the projected region of the cage 1 in the perpendicular direction to the outside. In this case, the size of protrusion is determined to be necessarily minimum so that the winding rope 5 can not come into contact with the cage 1 even if the winding rope 5 is vibrated.

In this connection, the projected region of the cage 1 in the perpendicular direction is defined as a region of a shade of the cage 1 formed by the cage 1 when a light flux is illuminated from an upper portion of the cage 1 in parallel with the first winding rope 5 (in the perpendicular direction) which is provided in the perpendicular direction from the attaching section 7 at the top of the hoistway.

In this arrangement, a necessary minimum space is ensured so that the winding rope 5 can not come into contact with the inside wall face of the hoistway 6 even when the winding rope 5 is vibrated.

Due to the above arrangement, it is possible to reduce the plane space of the hoistway 6.

In general, the elevator is provided a highly stiff safety gear or a cage lower frame at a lower portion of the cage. When the winding machine 4 is attached to this frame, it is unnecessary to provide a machine base for mounting the drum type winding machine 4, and the number of parts can be decreased as compared with a case in which the drum type winding machine 4 is attached to a portion except for the lower portion of the cage.

When the winding drum sheave 4*a* is provided with winding rope grooves of two directions in which one direction is set in the right screw direction and the other direction is set in the left screw direction with respect to the center of the winding drum sheave 4 in the axial direction, and when two different winding ropes are wound round the winding drum sheave 4*a* symmetrically with respect to the center of the winding drum sheave 4*a* in the axial direction and when the winding drum sheave 4*a* is arranged at the center of the side of the cage 1 on the bottom lower side of the cage 1, a force for elevating the cage 1 is always given to the center of the side of the cage 1, and no angular moment to rotate the cage 1 on the face formed by the two guide rails 2 is generated.

Accordingly, a load given from the guide roller 3*c* to the guide rail 2 can be reduced, and the manufacturing costs of manufacturing the guide roller and the guide rail can be reduced, and further the maintenance cost can be also reduced.

In this embodiment, the member for supporting an angular moment given to the cage 1 is a guide roller. However, it should be noted that as long as it is attached to the cage 1 and moved coming into contact with the guide rail 2 so as to support the angular moment, any other member such as a guide shoe described in following Embodiment 2 may be used.

Embodiment 2

Figure 3:
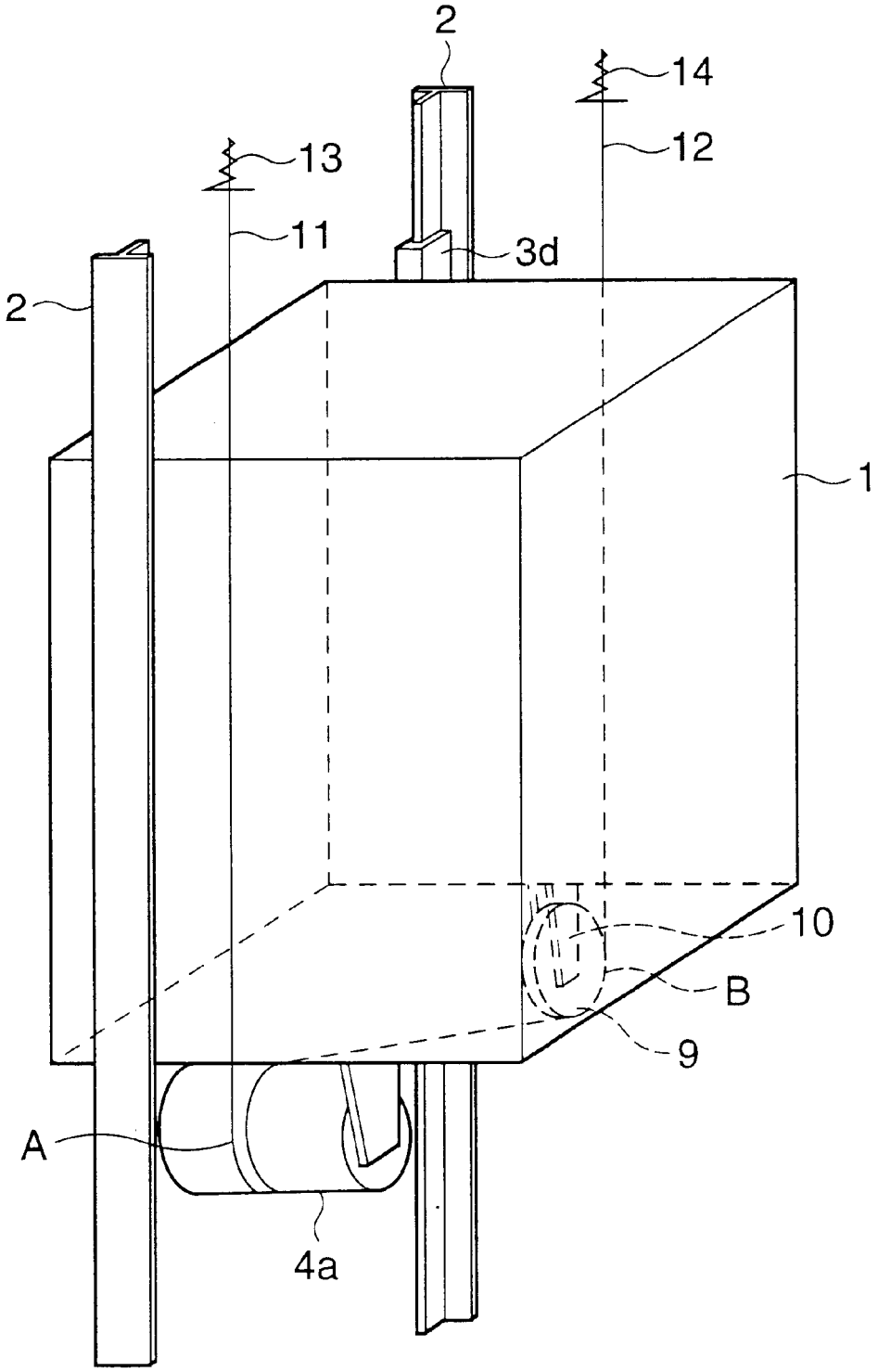
FIG. 3 is a perspective view briefly showing an arrangement of a self-propelled elevator of Embodiment 2.

FIG. 3 is a perspective view briefly showing an overall arrangement of a self-propelled elevator of Embodiment 2. In the view, reference numeral 1 is a cage, and reference numeral 2 is a guide rail, wherein two pieces of guide rails are arranged in the traverse direction so as to guide the elevating cage 1.

Reference numeral 3*d* is a guide shoe which corresponds to the guide roller shown in Embodiment 1, wherein four pieces of guide shoes are respectively arranged at a right upper, right lower, left upper and left lower position of the cage 1.

These guide shoes 3*d* slide on the guide rails 2 while they are supporting an angular moment given to the cage 1 on the plane formed by the two guide rails 2 and also they are supporting an angular moment given to the cage 1 round a perpendicular axis and a straight line connecting the two guide rails at the same height.

Reference numeral 4*a* is a winding drum sheave of the drum type winding machine 4 attached to a lower portion (lower side of the bottom portion) of the cage 1.

Reference numeral 9 is a suspension sheave arranged in the lower portion (lower side of the bottom portion) of the cage 1 and attached at a position symmetrical to the winding drum sheave 4*a* with respect to the gravity center of the cage 1 by the attaching member 10.

Reference numeral 11 is a first winding rope, one end of which is wound round the winding drum sheave 4*a* and the other end of which is fixed to the attaching section 13 at the top of the hoistway 6. In the same manner as that described in Embodiment 1, an end face shown by reference mark B in the drawing of the winding drum sheave 4*a* on which the first winding rope 11 comes into contact is located at a position so that the end face can be protruded from the projected region of the cage 1 in the perpendicular direction to the outside. In this case, the size of protrusion is determined to be necessarily minimum so that the winding rope 11 can not come into contact with the cage 1 even if the winding rope 11 is vibrated.

Reference numeral 12 is a second winding rope, one end of which is wound round the winding drum sheave 4*a* and further wound round the suspension sheave 9 and the other of which is fixed to the attaching section 14 at the top of the hoistway 6.

An end face (shown by reference mark B in the drawing) of the suspension sheave 9 round which the second winding rope 12, the end of which is fixed to the attaching portion 14 at the top of the hoistway, is wound and contacted is positioned so that the end face can be protruded outside the projected region of the cage 1 in the perpendicular direction, and this protruding size is determined to be a necessary minimum value so that the second winding rope 12 can not come into contact with the cage 1 even if the second winding rope 12 is vibrated.

In the above self-propelled elevator of this embodiment, the cage 1 is elevated by the first winding rope 11 and the second winding rope 12 of the two winding systems. Therefore, tension is equally given to both sides of the cage 1, and no angular moment to rotate the cage 1 on the plane formed by the two guide rails 2 is generated. Since the suspension sheave 9 is arranged at a position symmetrical to the winding drum sheave 4*a* with respect to the gravity center of the cage 1, no angular moment to rotate the cage 1 round a straight line connecting the two guide rails at the same height is generated.

Accordingly, a load given from the guide shoe 3*d* to the guide rail 2 can be reduced. As a result, improvements can be made in reducing the manufacturing cost and the maintenance expense of the guide shoe 3*d* and the guide rail 2.

Concerning the arrangement of the suspension sheave 9, in the same manner as that of the winding drum sheave 4*a*, an end face (shown by reference mark B in the drawing) of the suspension sheave 9 round which the second winding rope 12 is wound and contacted is positioned so that the end face can be protruded outside the projected region of the cage 1 in the perpendicular direction, and this protruding size is determined to be a necessary minimum value so that the winding rope 12 can not come into contact with the cage 1 even if the second winding rope 12 is vibrated. Therefore, it is possible to provide an effect to decrease a plane space of the hoistway 6.

In this embodiment, the member for supporting an angular moment given to the cage 1 is a guide shoe. However, it should be noted that as long as it is attached to the cage 1 and moved coming into contact with the guide rail 2 so as to support an angular moment, any other member such as a guide roller described in Embodiment 1 may be used.

Embodiment 3

Figure 4:
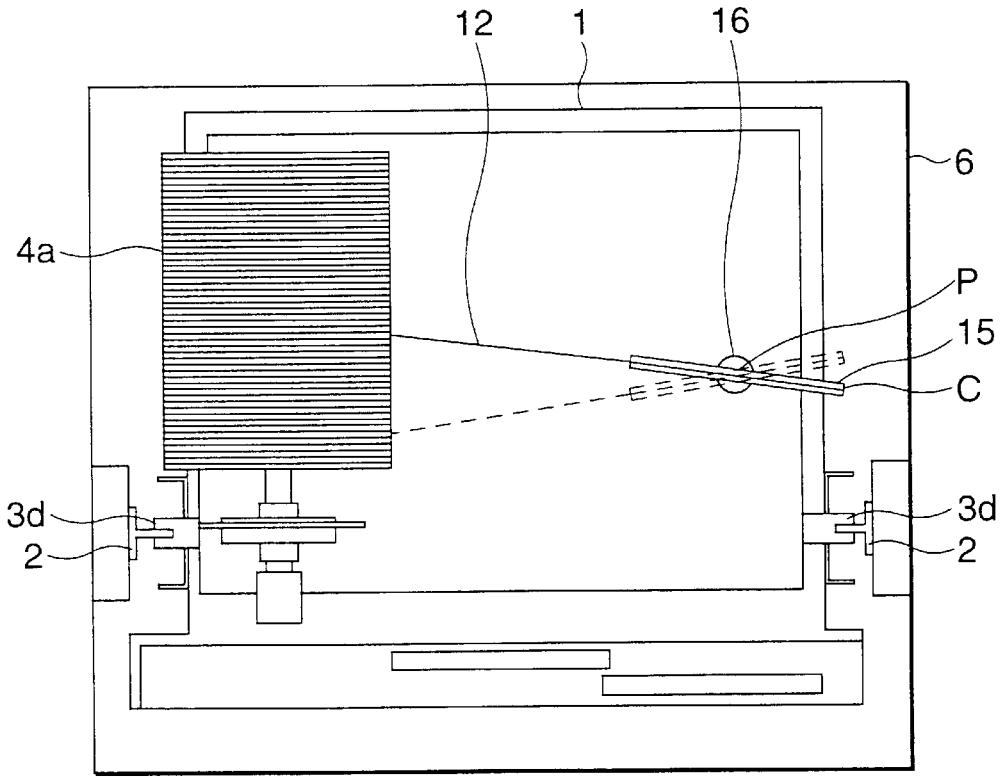
FIG. 4 is a plan view of a self-propelled elevator of Embodiment 3, wherein the view is taken from the lower side of the cage.

FIG. 4 is a plan view of a self-propelled elevator of Embodiment 3, wherein this view is taken from the bottom portion of the cage.

In the view, reference numeral 1 is a cage, reference numeral 2 is a guide rail, and reference numeral 3*d* is a guide shoe. In this structure, there are provided four guide shoes which are respectively arranged at a right upper position, right lower position, left upper position and left lower position of the cage 1. Reference numeral 4*a* is a winding drum sheave, reference numeral 6 is a hoistway, reference numeral 12-is a second winding rope, reference numeral 15 is a suspension sheave rotatably arranged at a position symmetrical to the winding sheave 4*a* with respect to the center line on the lower face of the bottom portion of the cage 1, and reference numeral 16 is a suspension sheave attaching member to which the suspension sheave 15 is attached capable of being swiveled round a perpendicular line which is perpendicular to the suspension sheave attaching face (lower face of the cage bottom portion) of the lower portion of the cage 1. In this case, an intersection point between the perpendicular line and the suspension sheave attaching face is indicated by reference mark P.

In the self-propelled elevator of Embodiment 2 shown in FIG. 3, instead of the suspension sheave 9 attached and fixed to the lower portion of the cage 1, the suspension sheave 15 attached capable of being swiveled so that it can be swiveled round point P is arranged as shown in FIG. 4.

Other points of the structure of this embodiment are the same as those of Embodiment 2. In the same manner as that of Embodiment 2, an end face of the winding drum sheave 4*a* round which the first winding rope 11 is wound and contacted is positioned so that the end face can be protruded outside the projected region of the cage 1 in the perpendicular direction, and this protruding size is determined to be a necessary minimum value so that the first winding rope 11 can not come into contact with the cage 1 even if the first winding rope 11 is vibrated.

An end face (shown by reference mark C in the drawing) of the suspension sheave 15 round which the second winding rope 12, the end of which is fixed to the attaching portion 14, is wound and contacted is positioned so that the end face can be protruded outside the projected region of the cage 1 in the perpendicular direction, and this protruding size is determined to be a necessary minimum value so that the second winding rope 12 can not come into contact with the cage 1 even if the second winding rope 12 is vibrated.

In this embodiment, the second winding rope 12 is wound round the winding drum sheave 4*a* so that the second winding rope 12 can not overlap each other. Therefore, when the cage 1 is elevated, a contact point of the second winding rope 12 with the winding drum sheave 4*a* is moved in the axial direction of the winding drum sheave 4*a*.

In this case, when the suspension sheave 15 can not be swiveled but fixed like Embodiment 2, an angle formed between the rope groove of the winding drum sheave 4*a* and the second winding rope 12 to be wound round it or an angle formed between the rope groove of the suspension sheave 15 and the second winding rope 12 to be wound round it is increased. This angle is referred to as a fleet angle in this specification, hereinafter. Therefore, abrasion is caused in the second winding rope 12, winding drum sheave 4*a* and suspension sheave 15 by the contact of the winding rope 12 with the winding drum sheave 4*a* or the suspension sheave 15, and further the second winding rope 12 is disengaged from the rope grooves.

On the other hand, in the self-propelled elevator of this embodiment in which the suspension sheave 15 is arranged being capable of rotating, the second winding rope 12 is moved on the winding drum sheave 4*a* in the axial direction of the winding drum sheave 4*a* as shown by the broken line in FIG. 4, and the suspension sheave 15 is swiveled when it follows the movement of the second winding rope 12. Accordingly, the fleet angle is decreased, and the problems of abrasion and disengagement of the rope can be solved.

Therefore, in addition to the effect of the self-propelled elevator of Embodiment 2 described before, the self-propelled elevator of this embodiment can provide the following effects. It is possible to realize a self-propelled elevator in which neither abrasion nor disengagement of the rope is caused so that the reliability of the self-propelled elevator is high.

Embodiment 4

Figure 5:
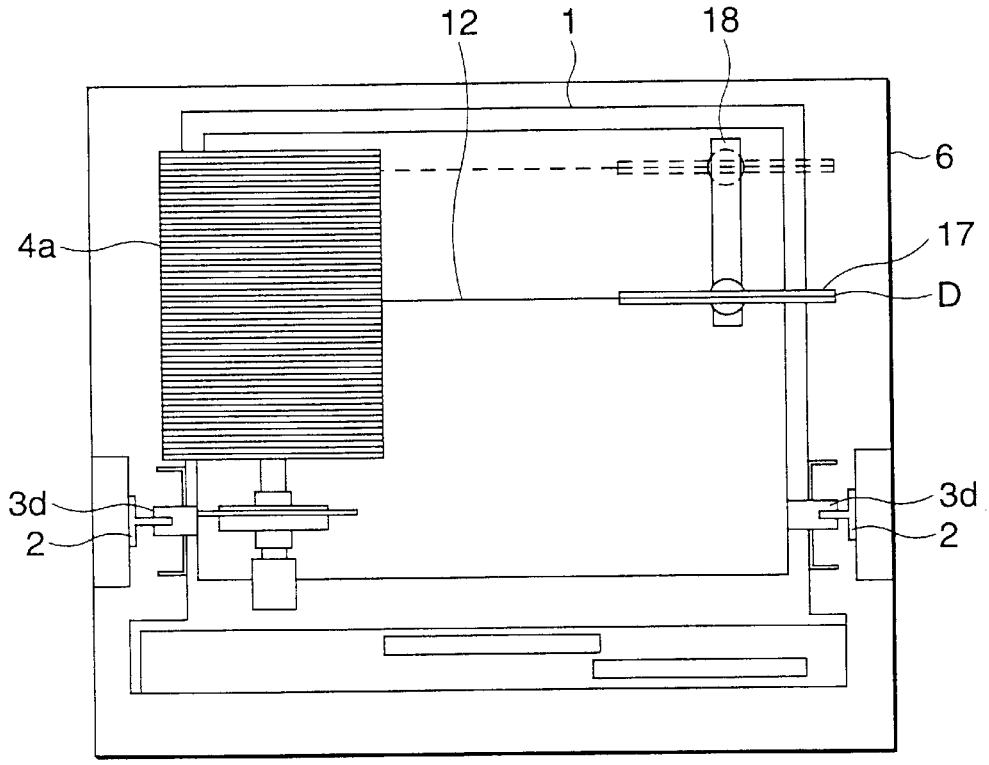
FIG. 5 is a plan view of a self-propelled elevator of Embodiment 4, wherein the view is taken from the lower side of the cage.

FIG. 5 is a plan view of the self-propelled elevator of Embodiment 4, wherein this view is taken from the bottom portion of the cage.

In the view, reference numeral 1 is a cage, reference numeral 2 is a guide rail, and reference numeral 3*d* is a guide shoe. Reference numeral 4*a* is a winding drum sheave, reference numeral 6 is a hoistway, reference numeral 12 is a second winding rope, reference numeral 17 is a suspension sheave arranged at a position symmetrical to the winding sheave 4*a* with respect to the center line on the lower face of the bottom portion of the cage 1, and reference numeral 18 is a suspension sheave attaching member having a mechanism by which the suspension sheave 17 can be freely moved in a direction parallel with the axial direction of the winding drum sheave 4*a*.

In the self-propelled elevator of Embodiment 2 shown in FIG. 3, instead of the suspension sheave 9 attached and fixed to the lower portion of the cage 1, the suspension sheave 17 capable of freely moving in a direction parallel with the axial direction of the winding drum sheave 4*a* is arranged as shown in FIG. 5.

Other points of the structure of this embodiment are the same as those of Embodiment 2. In the same manner as that of Embodiment 2, an end face of the winding drum sheave 4*a* round which the first winding rope 11 is wound and contacted is positioned so that the end face can be protruded outside the projected region of the cage 1 in the perpendicular direction, and this protruding size is determined to be a necessary minimum value so that the first winding rope 11 can not come into contact with the cage 1 even if the first winding rope 11 is vibrated.

An end face (shown by reference mark D in the drawing) of the suspension sheave 17 round which the second winding rope 12, the end of which is fixed to the attaching portion 14, is wound and contacted is positioned so that the end face can be protruded outside the projected region of the cage 1 in the perpendicular direction, and this protruding size is determined to be a necessary minimum value so that the second winding rope 12 can not come into contact with the cage 1 even if the second winding rope 12 is vibrated.

In this embodiment, in the same manner as that of Embodiment 3, the second winding rope 12 is wound round the winding drum sheave 4*a* so that the second winding rope 12 can not overlap each other. Therefore, when the cage 1 is elevated, a contact point of the second winding rope 12 with the winding drum sheave 4*a* is moved in the axial direction of the winding drum sheave 4*a*.

In this case, as shown by the broken line in the drawing, there is provided a suspension sheave attaching member 18 so that the suspension sheave 17 can follow a movement of the contact point of the second winding rope 12 with the winding drum sheave 4*a* and move in a direction parallel with the axial direction of the winding drum sheave 4*a*. Accordingly, the fleet angle is seldom created. Therefore, the problems of abrasion of the second winding rope 12, the winding drum sheave 4*a* and the suspension sheave 17 can be solved and the problem of disengagement of the rope can be also solved.

Therefore, in the same manner as that of the self-propelled elevator of Embodiment 3, in addition to the effect of the self-propelled elevator of Embodiment 2 described before, the self-propelled elevator of this embodiment can provide the following effects. It is possible to realize a self-propelled elevator in which neither abrasion nor disengagement of the rope is caused so that the reliability of the self-propelled elevator is high.

Embodiment 5

Figure 6:
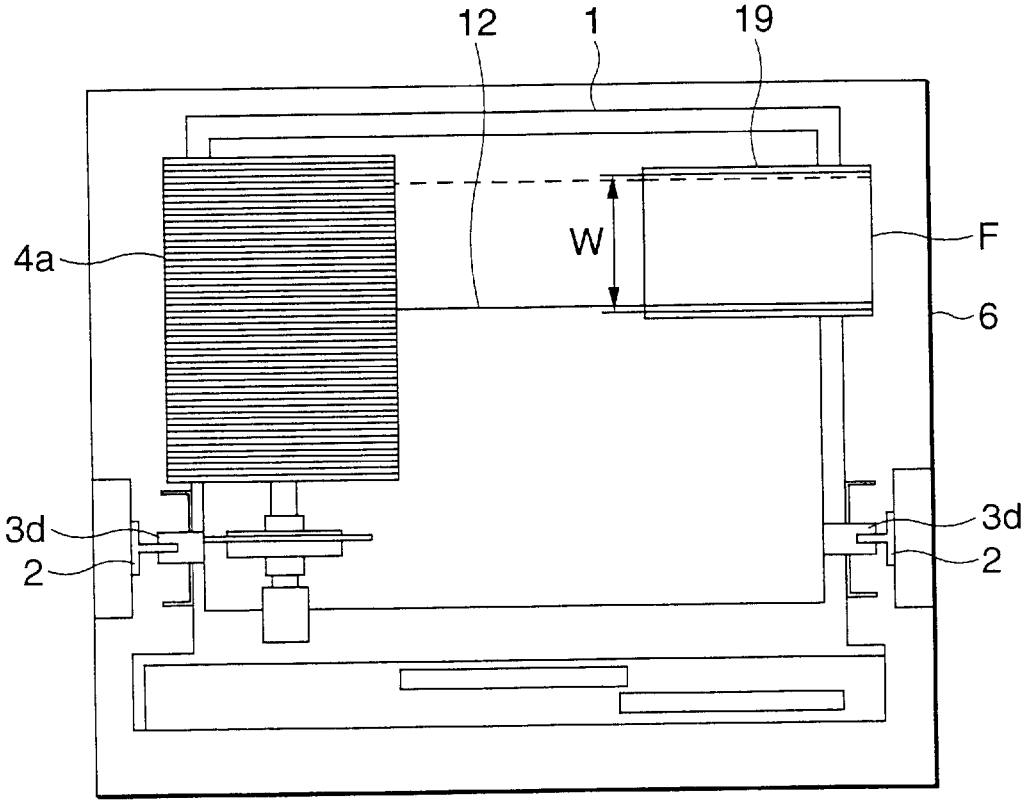
FIG. 6 is a plan view of a self-propelled elevator of Embodiment 5, wherein the view is taken from the lower side of the cage.

FIG. 6 is a plan view of the self-propelled elevator of Embodiment 4, wherein this view is taken from the bottom portion of the cage.

In the view, reference numeral 1 is a cage, reference numeral 2 is a guide rail, and reference numeral 3*d* is a guide shoe. Reference numeral 4*a* is a winding drum sheave, reference numeral 6 is a hoistway, reference numeral 12 is a second winding rope, and reference numeral 19 is a suspension sheave arranged at a position symmetrical to the winding sheave 4*a* with respect to the center line on the lower face of the bottom portion of the cage 1.

In this embodiment, instead elevator of Embodiment 2 shown in FIG. 3, instead of the suspension sheave 9 fixed to the lower portion of the cage 1, as shown in FIG. 6, there is provided a suspension sheave 19 having a width (width of a predetermined length) corresponding to a moving distance in the axial direction of the winding drum sheave 4*a* of the contact point of the second winding rope 12 with the winding drum sheave 4*a* according to the elevation of the cage 1, and no winding rope grooves are formed on the suspension sheave 19.

That is, a cylindrical circumferential face of the suspension sheave 19 of this embodiment round which the second winding rope 12 is wound has a width of the predetermined length shown by reference mark W in the drawing, and the circumferential face of the suspension sheave 19 is formed smooth so that the second winding rope 12 can slide smoothly on the face.

Other points of the structure of this embodiment are the same as those of Embodiment 2. In the same manner as that of Embodiment 2, an end face of the winding drum sheave 4*a* round which the first winding rope 11 is wound and contacted is positioned so that the end face can be protruded outside the projected region of the cage 1 in the perpendicular direction, and this protruding size is determined to be a necessary minimum value so that the first winding rope 11 can not come into contact with the cage 1 even if the first winding rope 11 is vibrated.

An end face (shown by reference mark F in the drawing) of the suspension sheave 19 round which the second winding rope 12, the end of which is fixed to the attaching portion 14, is wound and contacted is positioned so that the end face can be protruded outside the projected region of the cage 1 in the perpendicular direction, and this protruding size is determined to be a necessary minimum value so that the second winding rope 12 can not come into contact with the cage 1 even if the second winding rope 12 is vibrated.

In this embodiment, the second winding rope 12 is wound round the winding drum sheave 4*a* so that the second winding rope 12 can not overlap each other on the winding drum sheave 4*a*. Therefore, when the cage 1 is elevated, a contact point of the second winding rope 12 with winding drum sheave 4*a* is moved in the axial direction of the winding drum sheave 4*a*. At this time, the second winding rope 12 slides on the suspension sheave 19 so that the second winding rope 12 can pass through the shortest distance between the winding drum sheave 4*a* and the suspension sheave 19 as shown by the broken line in the drawing. Accordingly, there is no possibility that the fleet angle is created.

Therefore, the problems of abrasion of the second winding rope 12, the winding drum sheave 4*a* and the suspension sheave 19 can be solved and the problem of disengagement of the rope can be also solved.

Further, the problem of abrasion can be solved by adopting a means for reducing a frictional coefficient on the face where the suspension sheave and the winding rope come into contact with each other, for example, by adopting a means for supplying lubricant onto the face or adopting a means for providing an abrasion-resistant material on the surface of the suspension sheave.

Therefore, in the same manner as that of the self-propelled elevator of Embodiment 3 or 4, in addition to the effect of the self-propelled elevator of Embodiment 2 described before, the self-propelled elevator of this embodiment can provide the following effects. It is possible to realize a self-propelled elevator in which neither abrasion nor disengagement of the rope is caused so that the reliability of the self-propelled elevator is high.

Further, when the width of the suspension sheave 19 in the axial direction is determined to be the minimum length (predetermined length) at which the fleet angle in the case where the cage 1 is located at the highest floor and the fleet angle in the case where the cage 1 is located at the lowest floor are respectively not more than ±4° with respect to the rope grooves of the winding drum sheave 4*a*, the width of the suspension sheave 19 can be reduced and the manufacturing cost can be decreased.

Embodiment 6

Figure 7:
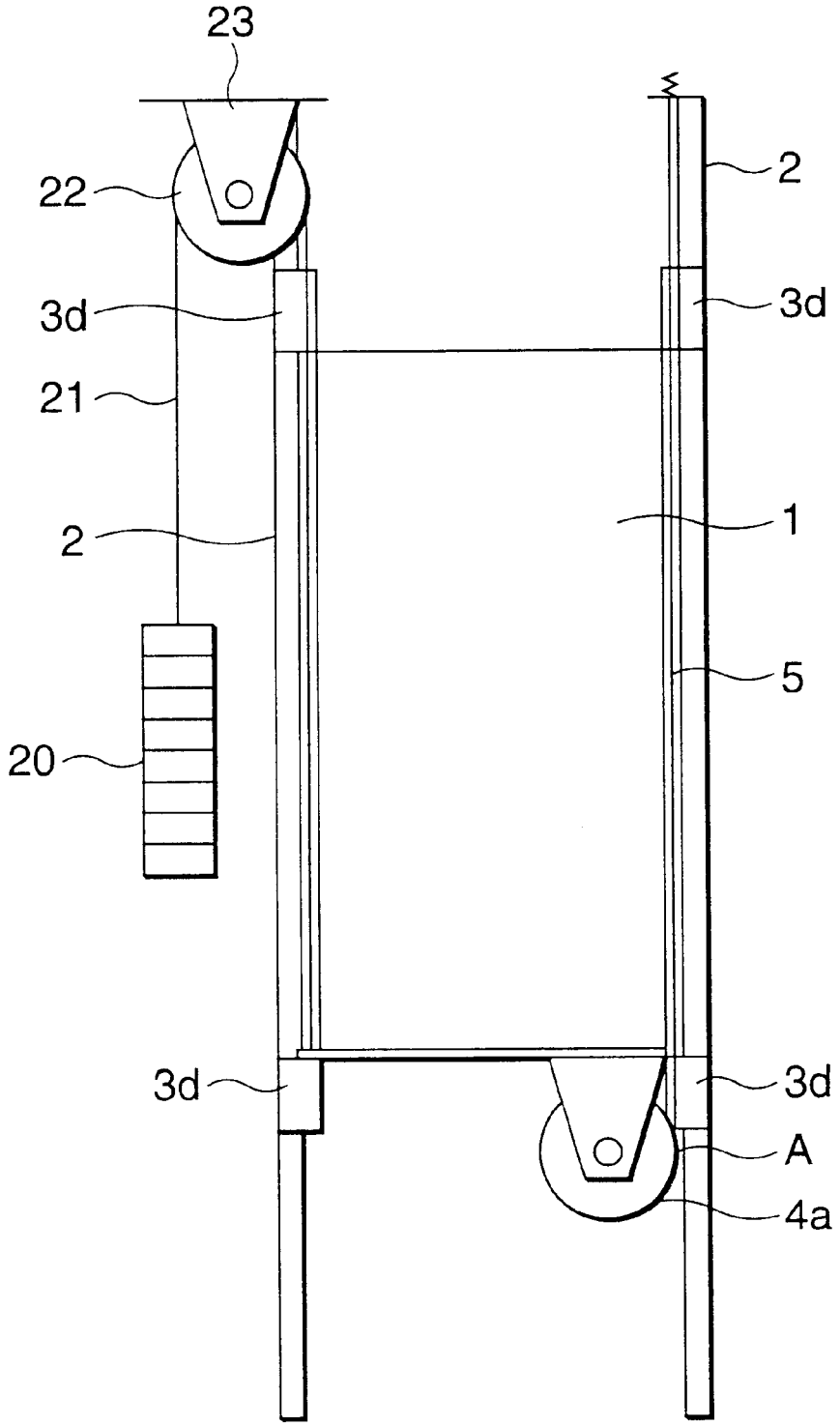
FIG. 7 is a side view briefly showing an arrangement of a self-propelled elevator of Embodiment 6.
Figure 8:
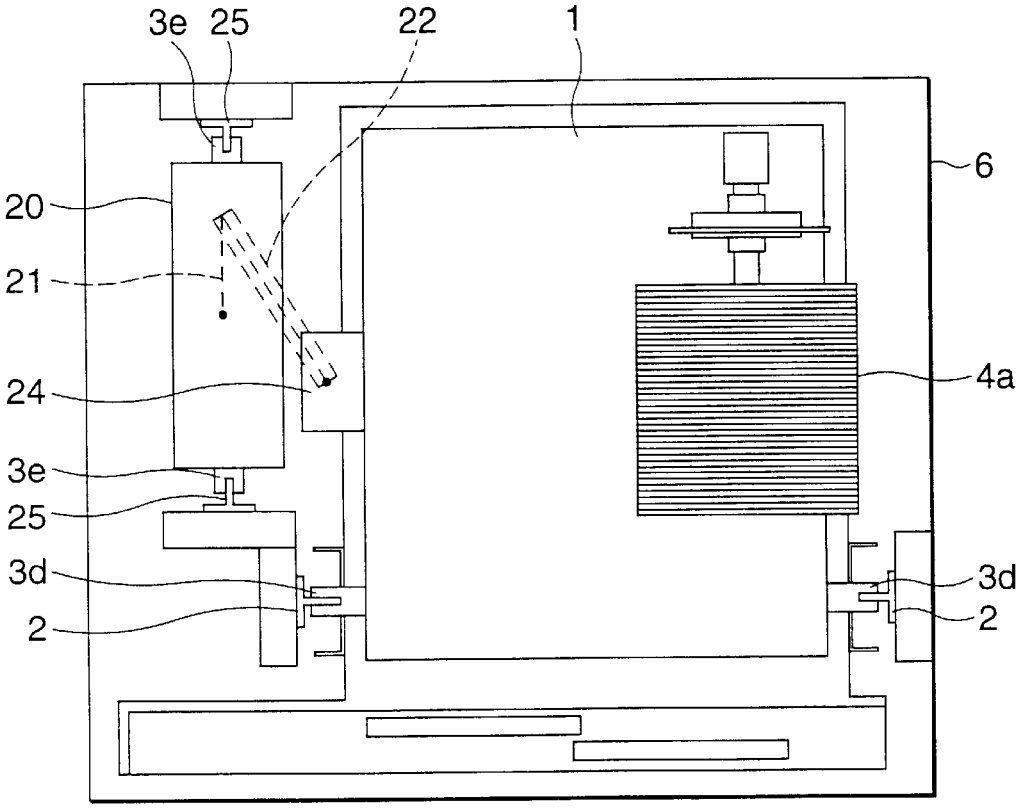
FIG. 8 is a plan view of a self-propelled elevator of Embodiment 6, wherein the view is taken from the lower side of the cage.

FIG. 7 is a side view briefly showing a structure of a self-propelled elevator of Embodiment 6. FIG. 8 is a plan view of the self-propelled elevator of Embodiment 6, wherein this view is taken from the bottom portion of the cage.

In FIGS. 7 and 8, reference numeral 1 is a cage, reference numeral 2 is a guide rail, wherein two guide rails 2 are arranged in parallel with each other in the traverse direction so as to guide the elevating cage 1, and reference numeral 3*d* is a guide shoe. In this structure, there are provided four guide shoes 3*d* which are respectively arranged at a right upper position, right lower position, left upper position and left lower position of the cage 1. Reference numeral 4*a* is a winding drum sheave, reference numeral 5 is a first winding rope reference numeral 6 is a hoistway, reference numeral 20 is a counterweight, reference numeral 21 is a rope for hanging the counterweight, reference numeral 22 is a return sheave, reference numeral 23 is an attaching member, reference numeral 24 is an attaching member, reference numeral 25 is a pair of guide rails for guiding the elevating counterweight 20, and reference numeral 3*e* is a guide shoe, wherein there are provided two guide shoes 3*e* which are respectively arranged at a right upper position and left lower position of the counterweight 20 and slide on the guide rails 25.

As shown in FIG. 7, one end of the rope 21 to hang the counterweight 20 is attached to the counterweight 20, and the other end of the rope 21 is attached to the cage 1 via the attaching section 24.

The rope 21 for the counterweight is wound round the return sheave 22 which is attached to the top portion of the hoistway 6 via the attaching member 23. This return sheave 22 inverts the elevating directions of the cage 1 and the counterweight 20. In the same manner as that of Embodiment 1, an end face of the winding drum sheave 4*a* on which the first winding rope 5 comes into contact is located at a position so that the end face can be protruded to the outside from the projected region of the cage 1 in the perpendicular direction, that is, an end portion, which is shown by mark A in FIG. 1, of the winding drum sheave 4*a* is located at a position so that the end portion can be protruded to the outside from the projected region of the cage 1 in the perpendicular direction. In this case, the size of protrusion is determined to be necessary minimum so that the first winding rope 5 can not come into contact with the cage 1 even if it is vibrated.

As described above, this embodiment is characterized in that: instead of the guide rollers 3*a*, 3*b*, 3*c*, the guide shoes 3*d* are provided in the self-propelled elevator of Embodiment 1, and further the counterweight is provided via the return sheave 22.

In the self-propelled elevator composed as described above, the counterweight 20 is provided via the return sheave 22. Therefore, the cage 1 is given a force, the direction of which is reverse to the direction of gravity, corresponding to the weight of the counterweight 20 by the rope 21 for hanging the counterweight 20.

Accordingly, a load given to the winding rope 5 wound round the winding drum sheave 4*a* can be reduced. As a result, it becomes possible to reduce the size of the drum type winding machine, and an output of an electric motor to drive the elevator can be reduced. Therefore, the electric power consumption can be reduced.

In this connection, when the weight of the counterweight 20 is increased, a tension of the winding rope 5 wound round the winding drum sheave 4*a* of the drum type winding machine can be reduced. However, it is necessary to prevent the winding rope 5 from loosening when a negative tension is given to the winding rope 5. Therefore, it is necessary to prevent the weight of the counterweight 20 from exceeding the self-weight of the cage 1.

Figure 9:
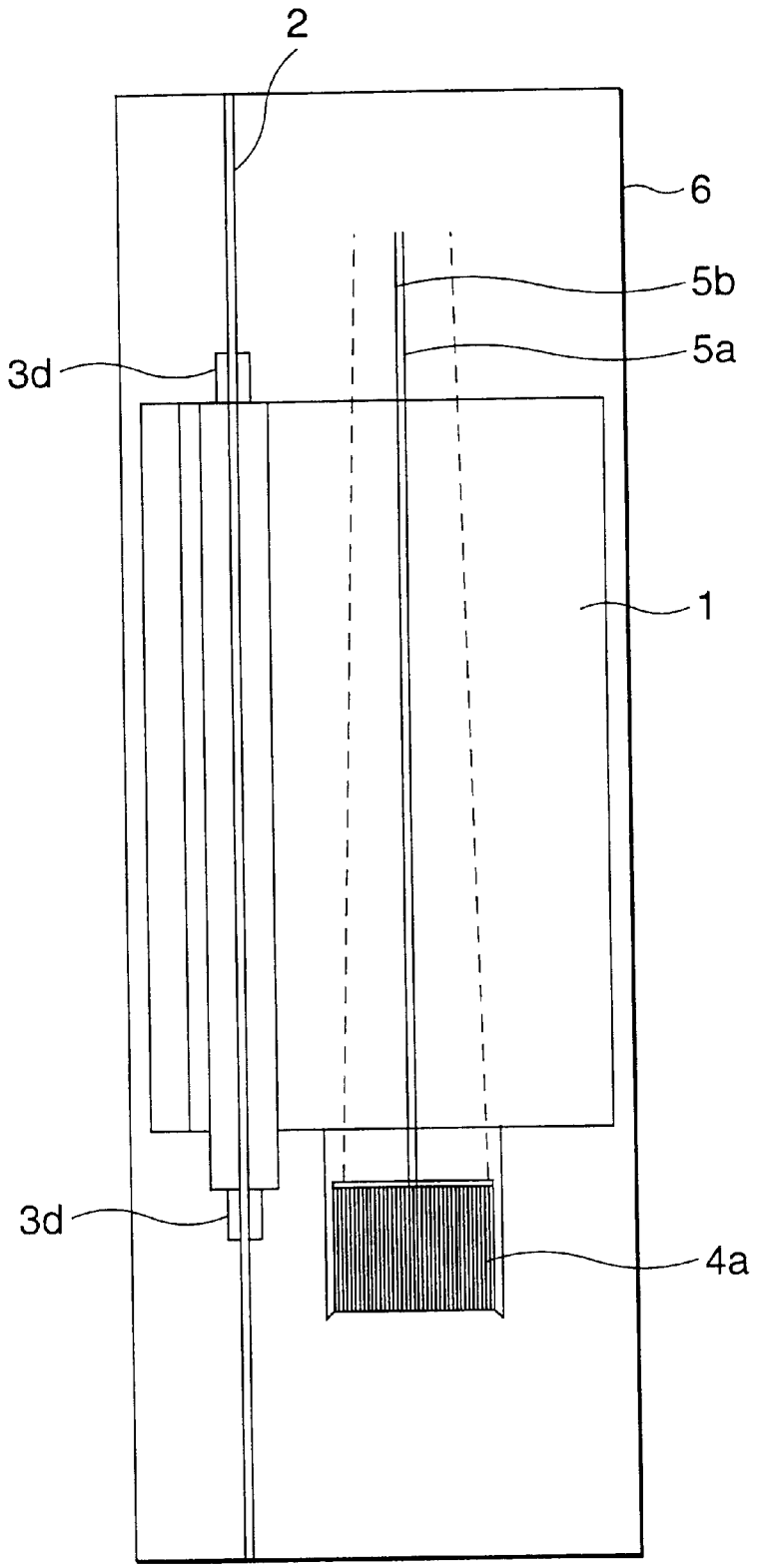
FIG. 9 is a side view for explaining another embodiment of a winding rope wound round a winding drum sheave in the self-propelled elevator of Embodiment 6.
Figure 10:
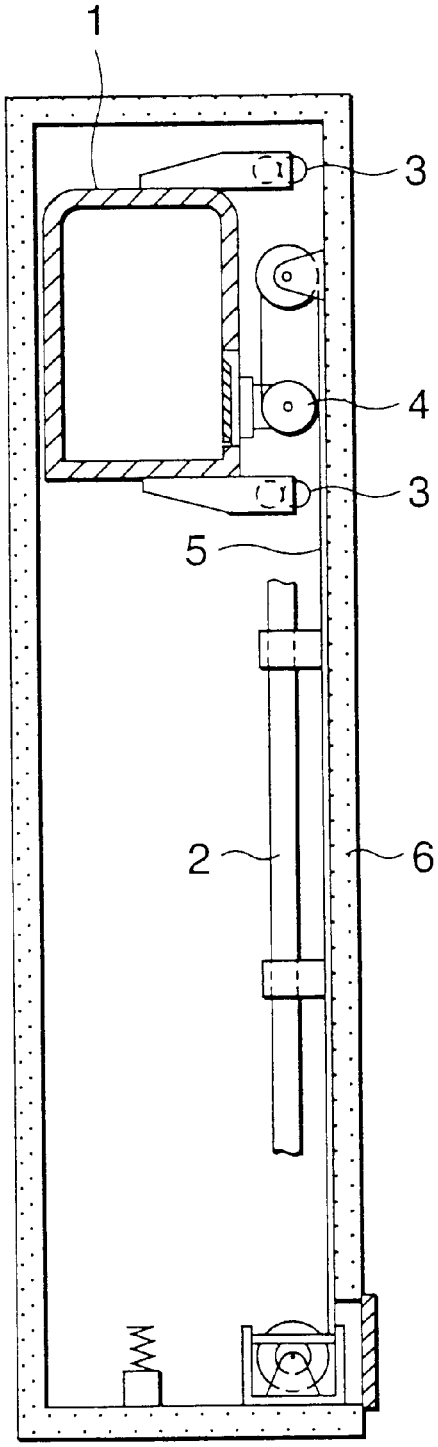
FIG.10 PRIOR ART
FIG. 10 is a side view briefly showing an arrangement of a conventional self-propelled elevator.

In this connection, as shown in FIG. 9, it is possible to make a force for elevating the cage 1 act on a line passing through the center of gravity of the cage 1 when the following arrangements are adopted. The winding rope grooves are formed in two directions on the winding drum sheave 4*a* in such a manner that the winding rope grooves on one side with respect to the center of the winding drum sheave 4*a* are formed in the right screw direction and the winding rope grooves on the other side with respect to the center of the winding drum sheave 4*a* are formed in the left screw direction. The different winding ropes 5*a*, 5*b* are respectively wound round the winding drum sheave 4*a* in different directions so that the different winding ropes 5*a*, 5*b* can be wound symmetrically with respect to the center of the winding drum sheave 4*a* in the axial direction. Further, the position of the winding drum sheave 4*a* and the position of the attaching section 24 of the counterweight 20 are arranged on the lower face of the bottom portion of the cage 1 symmetrically to each other with respect to the gravity center of the cage 1. Due to the above arrangement, it is possible to make a force for elevating the cage 1 act on a line passing through the center of gravity of the cage 1.

Accordingly, it is possible to reduce an angular moment to rotate the cage 1 generated by a rope tension on a plane formed by the two guide rails. Also, it is possible to reduce an angular moment to rotate the cage 1 round a straight line connecting the two guide rails 2 on the lower face at the bottom portion of the cage 1. Due to the foregoing, a burden given to each guide rail can be reduced.

When the weight of the counterweight is set at a value not less than ½ of the self-weight of the cage and not more than ½ of the sum of the maximum carrying capacity and the self-weight of the cage, it becomes possible to reduce a difference in tension between the winding ropes 5*a*, 5*b* and the counterweight rope 21 when the number of passengers is changed. Therefore, an angular moment to rotate the cage on the plane formed by the two guide rails 2 can be reduced.

Accordingly, the cage 1 can be prevented from tilting, so that the cage 1 can be stably elevated, and loads given to the guide shoes and guide rails can be reduced.

In this embodiment, instead of the guide rollers 3*a*, 3*b*, 3*c*, the guide shoes 3*d* are used in the self-propelled elevator of Embodiment 1, and further the counterweight 20 is provided via the return sheave 22. Of course, it is possible to adopt an arrangement in which the counterweight 20 is provided via the return sheave 22 in the self-propelled elevator of Embodiment 3.

According to the present invention, there is provided a self-propelled elevator in which a drum type winding machine is attached to a cage, and the cage is elevated along guide rails arranged in a hoistway by a first winding rope, one end of which is fixed to a top portion of the hoistway and the other end portion of which is directly wound round a winding drum sheave of the drum type winding machine, the self-propelled elevator characterized in that: the drum type winding machine is attached onto a lower side of a bottom portion of the cage so that an end face of the winding drum sheave round which the first winding rope is wound can be located outside a projected region of the cage in the perpendicular direction. Therefore, it is possible to reduce a plane space of the hoistway.

According to the present invention, there is provided a self-propelled elevator, in which a suspension sheave is provided at a position opposed to the winding drum sheave on the lower side of the bottom of the cage, a second winding rope is provided, one end of which is fixed to a top of the hoistway and the other end of which is wound round the winding drum sheave after it has been wound round the suspension sheave, and the suspension sheave is arranged at a position so that an end face of the second winding rope which is wound round the suspension sheave from the top of the hoistway can be located outside the projected region of the cage in the perpendicular direction. Due to the above arrangement, the cage is elevated by two systems of winding ropes including the first and the second system. Accordingly, an eccentric moment generated in the cage by tension given to the winding rope, and a burden given to each guide rail can be reduced.

According to the present invention, there is provided a self-propelled elevator, in which the suspension sheave is capable of swiveling. Due to the above arrangement, the fleet angle of the second winding rope can be reduced, and abrasion caused in the second winding rope and the suspension sheave can be reduced, and there is no possibility that the second winding rope is disengaged from the grooves of the winding drum sheave.

According to the present invention, there is provided a self-propelled elevator, in which the sheave can be freely moved in a direction parallel with the axial direction of the winding drum sheave. Therefore, the fleet angle of the second winding rope can be reduced, and abrasion caused in the second winding rope and the suspension sheave can be reduced, and there is no possibility that the second winding rope is disengaged from the grooves of the winding drum sheave.

According to the present invention, there is provided a self-propelled elevator, in which an outer circumferential portion of the suspension sheave round which the second winding rope is wound has a width of a predetermined length in a direction parallel with the axial direction of the winding drum sheave, and no grooves in which the second winding rope is wound are provided in the outer circumferential portion of the sheave. Due to the above arrangement, the second winding rope is capable of sliding on the suspension sheave. As a result, it becomes possible to decrease the fleet angle of the second winding rope to a value not more than a predetermined value. Therefore, abrasion caused in the second winding rope and the suspension sheave can be reduced, and there is no possibility that the second winding rope is disengaged from the grooves of the winding drum sheave.

According to the present invention, there is provided a self-propelled elevator, in which a rope is provided, one end of which is fixed to the cage and the other end of which is fixed to a counterweight, and the rope is wound round a return sheave arranged at the top of the hoistway between the cage and the counterweight. Due to the above arrangement, a load given to the drum type winding machine can be reduced, and dimensions of the electric motor can be reduced, so that the electric power consumption can be reduced.

According to the present invention, there is provided a self-propelled elevator, in which the weight of the counterweight is less than the self-weight of the cage. Consequently, there is no possibility that the winding rope is loosened, and it becomes possible to elevate the cage stably.

According to the present invention, there is provided a self-propelled elevator, in which the weight of the counterweight is not less than ½ of the self-weight of the cage and not more than ½ of the sum of the maximum carrying capacity and the self-weight of the cage. Due to the above arrangement, a difference in tension between the winding rope and the counterbalance rope can be reduced. Therefore, it becomes possible to reduce an angular moment, that is, it becomes possible to reduce a load given to each guide rail.

What is claimed is:

1. A self-propelled elevator comprising:

a cage;

first and second guide rails at opposite sides of the cage for supporting the cage horizontally and guiding the cage vertically;

a winding-drum machine including a drum, attached to a lower side of a bottom of the cage, so that an end face of the drum is located outside an area produced by projection of the cage in a direction parallel to the guide rails; and a first rope elevating the cage along the guide rails in a hoistway, a first end of the first rope being fixed to a top of the hoistway and a second end of the first rope being fixed to the drum and directly wound around the drum, wherein the cage is elevated along the guide rails only by the winding of the first rope around the drum.

2. The self-propelled elevator according to claim 1 further comprising:

a suspension sheave positioned opposite the drum on the lower side of the bottom of the cage; and a second rope, a first end of which is fixed to the top of the hoistway and a second end of which is wound around the drum after the second winding rope has been wound around the suspension sheave, wherein the suspension sheave is arranged at a position so that an end face of the second rope wound around the suspension sheave from the top of the hoistway is located outside the area produced by projection.

3. The self-propelled elevator according to claim 2, wherein the suspension sheave is capable of swiveling.

4. The self-propelled elevator according to claim 2, wherein the suspension sheave is freely movable in a direction parallel to an axis of rotation of the drum.

5. The self-propelled elevator according to claim 2, wherein an outer circumferential portion of the suspension sheave around which the second winding rope is wound has a width in a direction parallel to an axis of rotation of the drum, and no grooves in which the second winding rope is wound are provided on an outer circumferential portion of the suspension sheave.

6. The self-propelled elevator according to claim 1, further comprising:

a counterweight; and a second rope, a first end of which is fixed to the cage and the other end of which is fixed to the counterweight, the rope being wound around a return sheave arranged at the top of the hoistway between the cage and the counterweight.

7. The self-propelled elevator according to claim 6, wherein the counterweight is lighter in weight than the cage.

8. The self-propelled elevator according to claim 7, wherein the counterweight weighs not less than ½ of the weight of the cage and not more than ½ of the sum of maximum carrying capacity of the cage and the weight of the cage.

9. The self-propelled elevator according to claim 2, further comprising:

a counterweight; and a second rope, a first end of which is fixed to the cage and the other end of which is fixed to the counterweight, the rope being wound around a return sheave arranged at the top of the hoistway between the cage and the counterweight.

10. The self-propelled elevator according to claim 9, wherein the counterweight is lighter in weight than the cage.

11. The self-propelled elevator according to claim 10, wherein the counterweight weighs not less than ½ of the weight of the cage and not more than ½ of the sum of maximum carrying capacity of the cage and the weight of the cage.

* * * * *